US008816802B2

(12) United States Patent
Freimuth et al.

(10) Patent No.: US 8,816,802 B2
(45) Date of Patent: Aug. 26, 2014

(54) AUXILIARY TRIPPING DEVICE FOR AN ELECTRICAL SWITCHING DEVICE AND ELECTRICAL SWITCHING DEVICE

(71) Applicants: Michael Freimuth, Hirschau (DE); Jürgen Renner, Sulzbach-Rosenberg (DE)

(72) Inventors: Michael Freimuth, Hirschau (DE); Jürgen Renner, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/721,121

(22) Filed: Dec. 20, 2012

(65) Prior Publication Data

US 2013/0200963 A1 Aug. 8, 2013

(30) Foreign Application Priority Data

Feb. 8, 2012 (DE) ..... 10 2012 201 854

(51) Int. Cl.
*H01H 9/00* (2006.01)

(52) U.S. Cl.
USPC ..... 335/172; 335/73

(58) Field of Classification Search
USPC ..... 335/172, 73, 189, 190
See application file for complete search history.

(56) References Cited

U.S. PATENT DOCUMENTS

| | | | | | |
|---|---|---|---|---|---|
| 1,837,830 | A | * | 12/1931 | O'Keeffe | 335/20 |
| 2,848,630 | A | * | 8/1958 | McNicol et al. | 307/112 |
| 3,371,746 | A | * | 3/1968 | Engel | 185/37 |
| 4,001,742 | A | * | 1/1977 | Jencks et al. | 335/173 |
| 4,114,005 | A | * | 9/1978 | Maier et al. | 200/400 |
| 4,160,142 | A | * | 7/1979 | Clausing | 200/254 |
| 4,209,761 | A | * | 6/1980 | Klein et al. | 335/17 |
| 4,229,630 | A | * | 10/1980 | Wafer et al. | 218/149 |
| 4,286,242 | A | * | 8/1981 | Mrenna et al. | 335/160 |
| 4,301,434 | A | * | 11/1981 | Castonguay | 335/20 |
| 4,497,992 | A | * | 2/1985 | Kodera et al. | 200/400 |
| 5,401,928 | A | * | 3/1995 | Kelley | 200/510 |
| 5,575,381 | A | * | 11/1996 | Castonguay et al. | 200/401 |
| 5,673,786 | A | * | 10/1997 | Seymour et al. | 200/308 |

(Continued)

FOREIGN PATENT DOCUMENTS

| | | | |
|---|---|---|---|
| DE | 3909553 | A1 | 9/1990 |
| DE | 69412151 | T2 | 2/1999 |
| DE | 60225765 | T2 | 4/2009 |
| DE | 102009021754 | A1 | 11/2010 |

(Continued)

*Primary Examiner* — Shawki S Ismail
*Assistant Examiner* — Lisa Homza
(74) *Attorney, Agent, or Firm* — Harness, Dickey & Pierce, P.L.C.

(57) ABSTRACT

An auxiliary tripping device is configured to interrupt a flow of current in the event of an undervoltage and/or a current pulse in a subordinate power circuit. The tripping device includes a spring element, a storage element which can be moved between a tensioned and a detensioned position, a trip element for tripping a trip mechanism of the electrical switching device and an activation element, the storage element being embodied in the tensioned position, when activated by way of the activation element, to emit the stored mechanical energy to the trip element. In an embodiment, a movably supported blocking element is provided, which is connected functionally in a first position to the storage element when the storage element is in the tensioned position, so that the storage element is held by the blocking element and in a second position the blocking element releases the storage element to perform a movement.

17 Claims, 2 Drawing Sheets

(56) References Cited

U.S. PATENT DOCUMENTS

| | | | | | |
|---|---|---|---|---|---|
| 5,782,341 | A | * | 7/1998 | Calder et al. | 200/43.14 |
| 5,938,008 | A | * | 8/1999 | Wehrli et al. | 200/400 |
| 6,015,959 | A | * | 1/2000 | Slepian et al. | 200/400 |
| 6,307,455 | B1 | * | 10/2001 | Dolo et al. | 335/172 |
| 8,207,459 | B2 | * | 6/2012 | Bae | 200/50.32 |
| 8,526,153 | B2 | * | 9/2013 | Freimuth et al. | 361/115 |
| 2010/0288611 | A1 | * | 11/2010 | Freimuth et al. | 200/330 |
| 2012/0125752 | A1 | | 5/2012 | Yamamoto et al. | |

FOREIGN PATENT DOCUMENTS

| | | | |
|---|---|---|---|
| DE | 102009055854 | A1 | 6/2011 |
| EP | 0 389 075 | B1 | 2/1994 |
| EP | 0 612 092 | B1 | 8/1998 |
| EP | 1 274 109 | B1 | 3/2008 |
| GB | 2171559 | A | 8/1986 |
| JP | H03165408 | A | 7/1991 |
| WO | WO 9834260 | A1 | 8/1998 |
| WO | WO 2008067987 | A1 | 6/2008 |
| WO | WO 2011055564 | A1 | 5/2011 |

* cited by examiner

AUXILIARY TRIPPING DEVICE FOR AN ELECTRICAL SWITCHING DEVICE AND ELECTRICAL SWITCHING DEVICE

PRIORITY STATEMENT

The present application hereby claims priority under 35 U.S.C. §119 to German patent application number DE 10 2012 201 854.9 filed Feb. 8, 2012, the entire contents of which are hereby incorporated herein by reference.

FIELD

At least one embodiment of the present invention generally relates to an auxiliary tripping device for an electrical switching device and an electrical switching device.

BACKGROUND

It is known that auxiliary tripping devices can be used in electrical switching devices, in particular circuit breakers. Here the auxiliary tripping devices perform the task of assisting a tripping device of the electrical switching device, if the tripping device cannot itself produce the required energy for tripping, in particular for tripping a circuit breaker. This is the case in particular for circuit breakers with undervoltage and/or voltage tripping devices, in which magnetic tripping devices are generally used. Such a magnetic tripping device can trip the circuit breaker when the voltage is below a certain value or there is no voltage at all; it is then an undervoltage tripping device.

Additionally or alternatively the tripping device can also trip the circuit breaker when there is an electrical current pulse; it is then what is known as a voltage tripping device. The mechanical energy required for tripping, in particular for isolating switching contacts, is supplied by way of auxiliary tripping devices in such tripping devices. The auxiliary tripping devices must in particular be deactivated to emit energy, in particular mechanical energy. This mechanical energy is generally stored in a spring storage unit within the auxiliary tripping device. Often the energy is fed to the auxiliary tripping device by way of the handle of the circuit breaker and stored therein. During tripping the energy is released again and used to isolate the switching contacts of the circuit breaker.

The incorporation of such auxiliary tripping devices in an electrical switching device has proven problematic. In order to provide the auxiliary tripping device in a tensioned position after incorporation, in other words with mechanical energy stored in the spring element, it is known to tension the spring storage device of the auxiliary tripping device during incorporation. However this makes incorporation more difficult, as it is associated in particular with a greater space requirement. A further option is to incorporate the auxiliary tripping device in the electrical switching device, while this latter is activated. This procedure is problematic however as the safety of the user cannot then be ensured when such an auxiliary tripping device is incorporated.

SUMMARY

At least one embodiment of the present invention reduces or even eliminates at least one of the disadvantages of known auxiliary tripping devices for electrical switching devices as described above at least to some degree. In particular, an auxiliary tripping device for an electrical switching device and an electrical switching device are provided, which allow the incorporation of an auxiliary tripping device in a tensioned position in an electrical switching device in an economical and simple manner.

Further features and details of the invention will emerge from the subclaims, the description and the drawings. Features and details described in the context of the inventive auxiliary tripping device of course also apply here in the context of the inventive electrical switching device and vice versa, so that reference is or can always be made reciprocally to the individual aspects of the invention in respect of the disclosure.

According to a first aspect of an embodiment of the invention is directed to an auxiliary tripping device for an electrical switching device, in particular a circuit breaker, wherein the electrical switching device is configured to interrupt a flow of current in the event of an undervoltage and/or a current pulse in a subordinate power circuit, having a spring element, a storage element, which can be moved between a tensioned and a detensioned position, a trip element for tripping a trip mechanism of the electrical switching device and an activation element, wherein the storage element is embodied in the tensioned position to store a mechanical energy of the spring element and wherein the storage element is embodied in the tensioned position, when activated by the activation element, to emit the stored mechanical energy to the trip element. In particular, an embodiment of the inventive auxiliary tripping device is embodied in such a manner that a movably supported blocking element is provided, which is connected functionally in a first position to the storage element when the storage element is in the tensioned position, so that the storage element is held by the blocking element and in a second position the blocking element releases the storage element to perform a movement.

The storage element of an embodiment of an inventive auxiliary tripping device allows the mechanical energy of the spring element to be stored in this tensioned position. The storage element can be activated by the activation element, which is functionally connected in particular to the electrical switching device, with the storage element emitting the stored mechanical energy to the trip element on activation. The trip element can be functionally connected to the electrical switching device in such a manner that switching contacts of the electrical switching device can be isolated, in particular by a downstream mechanism, and the flow of current can thus be interrupted.

An inventive auxiliary tripping device of an embodiment therefore allows the energy required to release the switching contacts of the electrical switching device to be provided. An of an embodiment the inventively provided blocking element allows the storage element to be held in its tensioned position, in particular regardless of possible activation of the storage element by the activation element. It is therefore possible to tension the storage element during production or before assembly of the auxiliary tripping device and fix it in this tensioned position. The auxiliary tripping device can thus be delivered in a tensioned state.

BRIEF DESCRIPTION OF THE DRAWINGS

The present invention is described with reference to the accompanying schematic drawings, in which.

Elements of identical function and mode of operation are shown with the same reference characters in FIGS. 1 and 2 respectively.

DETAILED DESCRIPTION OF THE EXAMPLE EMBODIMENTS

Figure 1:
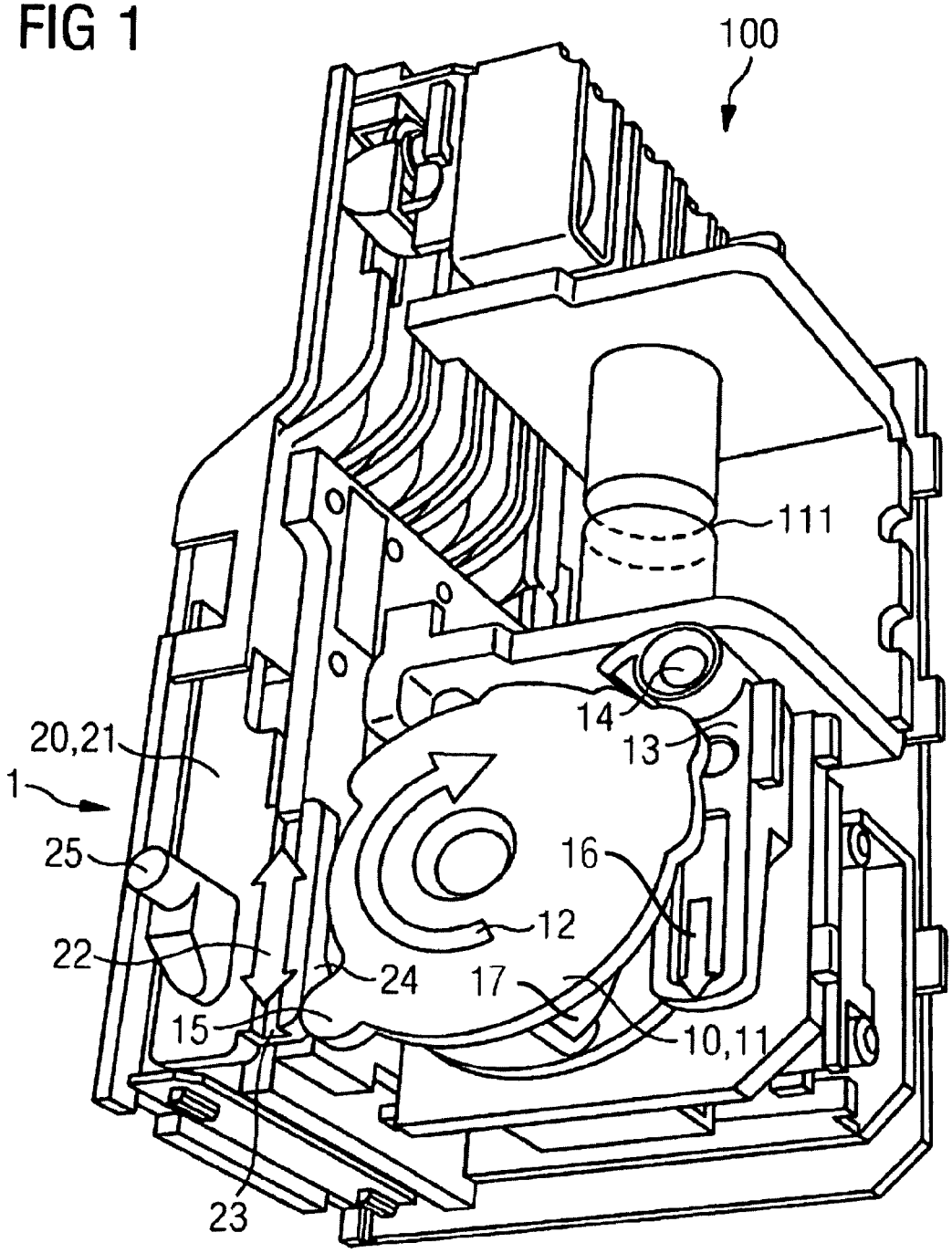
FIG. 1 shows a perspective partial view of an electrical switching device with an inventive auxiliary tripping device and FIG. 2 shows a further partial view of an electrical switching device with an inventive auxiliary tripping device.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

According to a first aspect of an embodiment of the invention is directed to an auxiliary tripping device for an electrical switching device, in particular a circuit breaker, wherein the electrical switching device is configured to interrupt a flow of current in the event of an undervoltage and/or a current pulse in a subordinate power circuit, having a spring element, a storage element, which can be moved between a tensioned and a detensioned position, a trip element for tripping a trip mechanism of the electrical switching device and an activation element, wherein the storage element is embodied in the tensioned position to store a mechanical energy of the spring element and wherein the storage element is embodied in the tensioned position, when activated by the activation element, to emit the stored mechanical energy to the trip element. In particular, an embodiment of the inventive auxiliary tripping device is embodied in such a manner that a movably supported blocking element is provided, which is connected functionally in a first position to the storage element when the storage element is in the tensioned position, so that the storage element is held by the blocking element and in a second position the blocking element releases the storage element to perform a movement.

The storage element of an embodiment of an inventive auxiliary tripping device allows the mechanical energy of the spring element to be stored in this tensioned position. The storage element can be activated by the activation element, which is functionally connected in particular to the electrical switching device, with the storage element emitting the stored mechanical energy to the trip element on activation. The trip element can be functionally connected to the electrical switching device in such a manner that switching contacts of the electrical switching device can be isolated, in particular by a downstream mechanism, and the flow of current can thus be interrupted.

An inventive auxiliary tripping device of an embodiment therefore allows the energy required to release the switching contacts of the electrical switching device to be provided. An of an embodiment the inventively provided blocking element allows the storage element to be held in its tensioned position, in particular regardless of possible activation of the storage element by the activation element. It is therefore possible to tension the storage element during production or before assembly of the auxiliary tripping device and fix it in this tensioned position. The auxiliary tripping device can thus be delivered in a tensioned state.

It is further possible for of an embodiment the inventive auxiliary tripping device, in particular the storage element of the inventive auxiliary tripping device, to be tensioned by the user before incorporation in an electrical switching device and to be held in its tensioned position by the blocking element. After incorporation of the thus pretensioned auxiliary tripping device the blocking element can be moved to its second position, in which the blocking element releases the storage element to perform a movement. The storage element is thus no longer held in its tensioned position by the blocking element, therefore the blocking element no longer blocks movement of the storage element for emitting the stored energy.

Because incorporation of the auxiliary tripping device has been completed at this point, the activation element can hold the storage element in the tensioned position. The activation element will release the storage element in a situation where there is in particular an undervoltage or total absence of voltage in the subordinate power circuit or a large current pulse, as is present in the case of a short circuit, at the electrical switching device. In such an instance it is necessary for the safety of the downstream power circuit and in particular users of the subordinate power circuit to isolate the switching contacts of the electrical switching device. When the activation element activates the storage element in such an instance, the storage element can bring about isolation of the switching contacts of the electrical switching device by way of the trip element.

The provision of a blocking element in an embodiment of an inventive auxiliary tripping device is therefore a particularly simple way of pretensioning the auxiliary tripping device and in particular the storage element of the auxiliary tripping device before incorporation of the auxiliary tripping device in an electrical switching device or of keeping the storage element in a tensioned position. Complex tensioning of the auxiliary tripping device during incorporation or incorporation of the auxiliary tripping device in an activated electrical switching device is not necessary with the inventive auxiliary tripping device.

Provision can also be made with an embodiment of an inventive auxiliary tripping device for the storage element to be configured as a rotary wheel. A rotary wheel, in particular in conjunction with a spiral spring, is a particularly compact way of creating a storage element. In particular a rotary wheel, primarily compared with a moving lever, can ensure that the storage element is blocked by external elements, which penetrate into the auxiliary tripping device and prevent movement of the storage element.

Provision can also be made with an inventive auxiliary tripping device for the blocking element to have a first and a second contact surface, it being possible to establish the functional connection between the storage element and the blocking element by way of the contact surfaces, with the first contact surface allowing the storage element to be moved into the tensioned position during movement of the blocking element from the second to the first position and the second contact surface holding the storage element in the tensioned position when the blocking element is in the first position. By having two contact surfaces to establish the functional connection between the storage element and the blocking element the blocking element can be used both to hold the storage element in its tensioned position and to tension the storage element. No further component is therefore required to tension the storage element.

The storage element can be moved for this purpose in a form-fit manner with the first contact surface during movement of the blocking element from its second to its first position. This moves the storage element from its detensioned position to its tensioned position, thereby tensioning the spring element connected to the storage element and storing mechanical energy. When the blocking element is in its first position, the second contact surface in particular is connected functionally in a form-fit manner to the storage element. The storage element is blocked in a form-fit manner by the second contact surface. Because both the tensioning and blocking of the storage element can be brought about by the blocking element, the structure of the auxiliary tripping device can be particularly simple with few additional components. This saves both assembly time and also cost.

According to one preferred development of an embodiment of an inventive auxiliary tripping device provision can be made for the first and second contact surface to be angled, in particular perpendicular or approximately perpendicular, in relation to one another. In particular for example a storage element configured as a rotary wheel can have a connecting element, which is provided to configure the functional connection to the blocking element. This connecting element can be configured in particular as a cam. The cam can be moved with the first contact surface and the storage element configured as a rotary wheel can be rotated to its tensioned position.

When the blocking element moves past the storage element in an in particular linear movement, its first contact surface will come into contact with the example cam of the storage element first. From a certain point the storage element will then come into contact with the second contact surface, which is disposed so that its is angled, in particular perpendicular or approximately perpendicular, in relation to the first contact surface. At the second contact surface the storage element is no longer tensioned further but simply held in its tensioned position. An arrangement of the first and second contact surface at an angle, in particular perpendicular or approximately perpendicular, in relation to one another, therefore allows a particularly simple embodiment of a blocking element, by which the storage element can be both tensioned and also held in the tensioned position.

In one particularly preferred embodiment of an inventive auxiliary tripping device provision can be made for the blocking element to have a contact element to establish a functional connection to the electrical switching device, in particular to a handle of the electrical switching device. Such a contact element allows actuation of the blocking element by the handle of the electrical switching device. Such a handle is provided on most electrical switching devices.

Actuation of the blocking element by a handle of the switching device has two major advantages in particular. Firstly the electrical switching device will be in its off position after incorporation of the auxiliary tripping device. The contact element, which is functionally connected to the handle of the electrical switching device, moves the blocking element from its first position to its second position, in which the storage element is released, on activation of the electrical switching device. Activation of the storage element by the activation element is thus possible when the electrical switching device is activated.

After the electrical switching device has been tripped in the event of an undervoltage or a current pulse, the functional connection to the electrical switching device, in particular to a handle of the electrical switching device, allows the blocking element to be used by way of the contact element to retension the storage element. For this purpose the blocking element can be moved by way of the handle of the electrical switching device from its releasing second position to its blocking first position. After this operation the storage element is back in its tensioned position. On activation of the electrical switching device, the functional connection established by the contact element between the blocking element and the handle of the electrical switching device allows the blocking element to be moved back again from its blocking first position to its releasing second position. The mechanical energy stored in the storage element is then available again for a subsequent tripping of the electrical switching device.

Provision can also be made with an embodiment of an inventive auxiliary tripping device for the activation element to be configured so that the activation element can be functionally connected to the electrical switching device, so that the activation element activates the storage element in the event of an undervoltage and/or a current pulse in a power circuit subordinate to the electrical switching device. The subordinate power circuit can be monitored by the electrical switching device in such a manner that the electrical switching device isolates switching contacts in the event of an undervoltage and/or a current pulse, thereby interrupting the flow of current.

An inventive auxiliary tripping device can be used to provide the energy required for such isolation of the switching contacts. Due to the functional connection between the activation element and the electrical switching device it can be ensured that when the electrical switching device is tripped, the energy from the storage element of the auxiliary tripping device can also be used to isolate the switching contacts. The functional connection here is in particular configured so that it is sensitive to undervoltages and/or current pulses in the subordinate power circuit. This can be achieved in particular by using an electromagnet.

Provision can also be made in a preferred manner with an embodiment of an inventive auxiliary tripping device for the trip element to be configured so that the trip element can be functionally connected to the electrical switching device, so that when the storage element is activated by the trip element, an interruption of the flow of current can be brought about in the electrical switching device. Due to the additional energy of the auxiliary tripping device it can be ensured that the switching contacts can be reliably isolated in the electrical switching device. The mechanical energy here is emitted from the storage element to the trip element of the inventive auxiliary tripping device.

The trip element can in particular be functionally connected to the electrical switching device, in particular to a switching mechanism of the electrical switching device. The switching mechanism is embodied to isolate switching contacts in the electrical switching device from one another. Due to a functional connection between the auxiliary tripping device and the electrical switching device, in particular between the trip element of the inventive auxiliary tripping device and a switching mechanism of the electrical switching device, it can be ensured that the additional mechanical energy that can be supplied by an inventive auxiliary tripping device can also isolate the switching contacts of the electrical switching device reliably from one another.

According to a second aspect of an embodiment of the invention the object is achieved by an electrical switching device for interrupting a flow of current in the event of an undervoltage and/or a current pulse in a subordinate power circuit, having at least two switching contacts, across which a current can flow and which can be isolated in the event of an undervoltage and/or a current pulse, an auxiliary tripping device and a switching mechanism for isolating the switching contacts, wherein the switching mechanism can be actuated by the auxiliary tripping device in the event of an undervoltage and/or a current pulse in the subordinate power circuit. In particular, an embodiment of the inventive electrical switching device is embodied so that the auxiliary tripping device is configured according to embodiments of the first aspect of the invention. All the advantages described in conjunction with an inventive auxiliary tripping device according to embodiments of the first aspect of the invention therefore naturally also apply to an inventive electrical switching device having such an auxiliary tripping device.

Provision can also be made with an embodiment of an inventive electrical switching device for the electrical switching device to have at least one electromagnet, through which at least some of the current can flow, the activation element of the auxiliary tripping device being functionally connected to the electromagnet in such a manner that the activation element activates the storage element in the event of an undervoltage and/or a current pulse in a power circuit subordinate to the electrical switching device. An electromagnet is sensitive to changes, in particular current changes, in a subordinate power circuit. Such changes can occur in the event of voltage fluctuations, as occur with undervoltage or a total absence of voltage.

Current pulses, as can occur for example with a short circuit, also represent such changes. The changes in the power circuit bring about a change in the magnetic field generated by the electromagnet. Such changes in the magnetic field or the magnetic force generated as a result allow the activation element of the auxiliary tripping device to be activated by way of the existing functional connection. In the event of such a change in the power circuit, as can occur in particular with undervoltage, a total absence of voltage or a current pulse, this causes the activation element of the auxiliary tripping device to be activated so that the activation element releases the storage element of the auxiliary tripping device. The mechanical energy of the spring element stored in the storage element of the auxiliary tripping device can then be emitted to the trip element of the auxiliary tripping device.

A downstream switching unit of the electrical switching device connected to the trip element of the auxiliary tripping device, driven by the energy supplied by the auxiliary tripping device, can then isolate the switching contacts of the electrical switching device. An electromagnet here represents a particularly conventional and effective way of providing a functional connection between the electrical switching device and the auxiliary tripping device positioned in or on the electrical switching device.

Provision can also be made with an embodiment of an inventive electrical switching device for the electrical switching device to have a handle, the handle being functionally connected to the blocking element of the auxiliary tripping device in such a manner that the blocking element can be moved optionally to the first or second position when the handle is actuated. This in particular allows actuation of the blocking element by the handle of the electrical switching device. The blocking element can be moved from its first to its second position. This allows the storage element of the electrical auxiliary tripping device to be released.

Conversely the blocking element can also be moved from its second to its first position. This allows the storage element of the auxiliary tripping device to be moved to its tensioned position and to be blocked there. All the functions of the blocking element can thus be served by the handle of the electrical switching device.

The use of the handle of the electrical switching device to operate the blocking element of the auxiliary tripping device is a particularly convenient way for the user to operate the blocking element of the auxiliary tripping device. In particular no further switches or operating elements are required to operate the auxiliary tripping device, in particular the blocking element of the auxiliary tripping device.

Provision can also be made with an embodiment of an electrical switching device for the electrical switching device to be a circuit breaker, in particular a molded case circuit breaker. Circuit breakers are in particular electromagnetic automatic switches. They can be used in particular as power protection switches to protect power circuits against short circuit and/or overload and/or voltage fluctuations. They are also widely used as motor protection switches. Configuring the electrical switching device as a circuit breaker, in particular as a molded case circuit breaker, allows the electrical switching device to be used in a wide range of electrical applications.

FIG. 1 shows a perspective view of a part of an electrical switching device 100. The auxiliary tripping device 1 is integrated in the switching device 100. The central component of an embodiment of the inventive auxiliary tripping device 1 is a storage element 10, which is in its tensioned position 11 in the illustrated state. The storage element 10 allows the mechanical energy of a spring element 17 to be stored in this tensioned position. The storage element 10 is connected by way of a sliding block guide to the trip element 13. The storage element 10 can also be activated by an activation element 14.

During activation of the storage element 10 in its tensioned position 11 by the activation element 14, the storage element 10 moves in a movement 12, running clockwise. This causes the trip element 13 to move in a linear movement 16, with a subordinate switching mechanism (not shown) of the electrical switching device 100 isolating the switching contacts (also not shown) of the electrical switching device 100. In this process the activation element 14 is functionally connected to an electromagnet 111 of the electrical switching device 100. Voltage fluctuations and/or current pulses in the power circuit subordinate to the electrical switching device 100 can be registered using the electromagnet 111. In particular the magnetic force of the electromagnet 111 can influence the activation element 14 so that it activates the storage element 10 when the power circuit subordinate to the electrical switching device 100 is in a critical state.

A cam 15 is also configured as a single piece on the storage element 10. Said cam 15 can be functionally connected to the blocking element 20. In the illustrated state of the electrical switching device 100 the blocking element 20 is in its first position 21. Disposed on the blocking element 20 are a first contact surface 23 and a second contact surface 24. In the illustrated state the cam 15 of the storage element 10 rests against the second contact surface 24 of the blocking element 20. This second contact surface 24 blocks the rotational movement 12 of the storage element 10.

The illustrated state of an embodiment of the inventive auxiliary tripping device therefore corresponds to a state in which the auxiliary tripping device 1 is present with the storage element 10 in the tensioned state 11, it being possible for the auxiliary tripping device 1 to be delivered and also to be incorporated in an electrical switching device 100 in this state. The blocking element 20 can execute a linear movement 22. When the blocking element 20 executes this linear movement 22 in the direction of the electromagnet 111 in the illustrated state, the storage element 10, in particular the cam 15 of the storage element 10, is released again. The storage element 10 is then only still held in its tensioned position 11 by the activation element 14.

In the event of voltage fluctuations and/or current pulses the activation element 14 releases the storage element 10 by activation and the switching contacts are isolated in the electrical switching device 100 by way of the functional connection to the trip element 13. If, with the storage element 10 in this detensioned position, the blocking element 20, which is then in its second position, is moved back into its first position, the cam 15 of the storage element 10 is moved with the first contact surface 23 of the blocking element 20 in a form-fit manner and the storage element 10 is thus moved back into its tensioned position 11. A contact element 25 for operating the blocking element 20 is provided in particular on the blocking element 20 for this movement 22.

Figure 2:
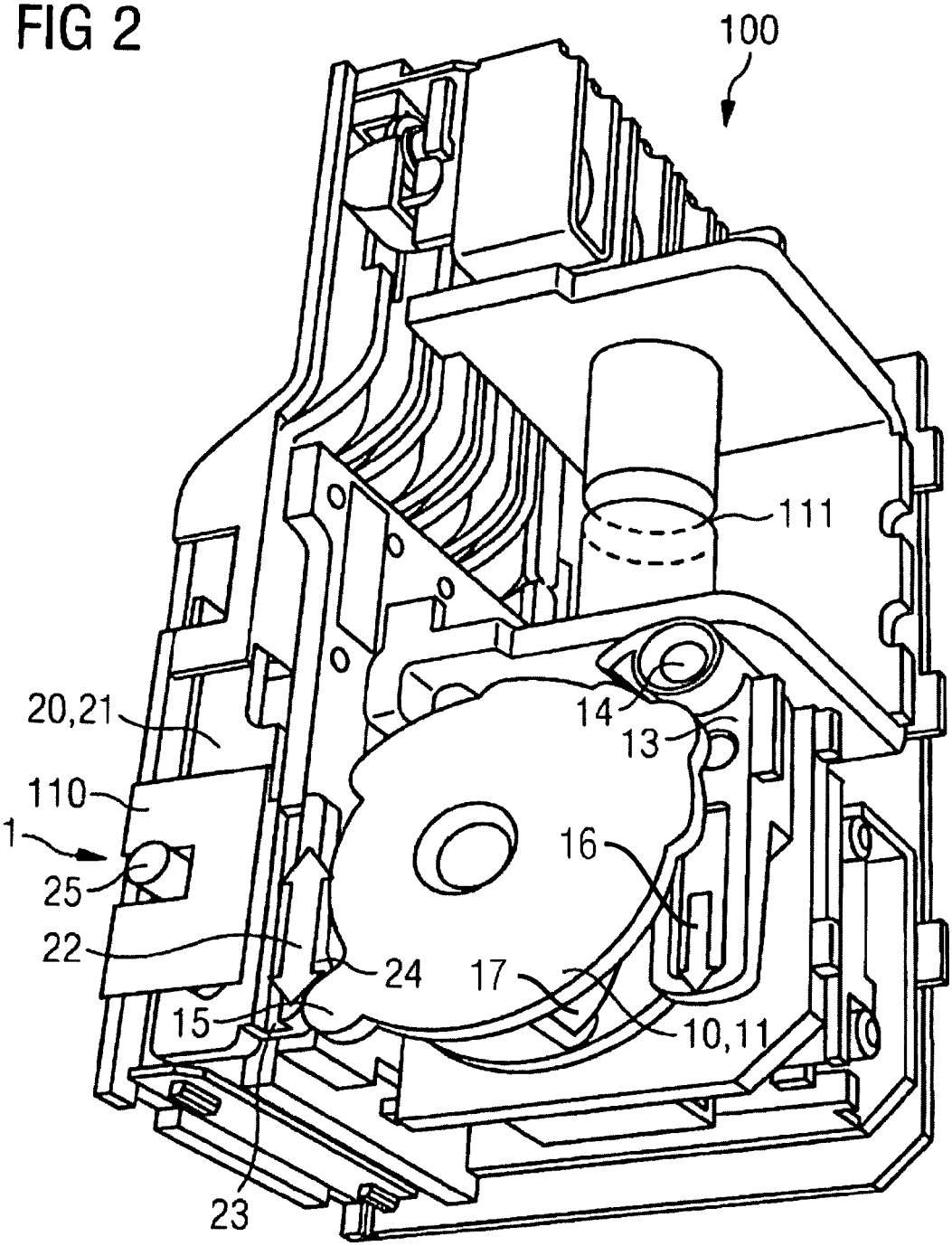

This is shown particularly clearly in FIG. 2, where a handle 110 of the electrical switching device is schematically provided in addition to the components of the electrical switching device 100 and of the auxiliary tripping device 1 already described in FIG. 1. The handle 110 is functionally connected to the contact element 25 of the blocking element 20. During movement of the handle 110 the blocking element 20 of the auxiliary tripping device 1 is also moved. In the illustrated state the electrical switching device 100 is in its off position. When the handle 110 is moved to the on position for the electrical switching device, in other words displaced in the direction of the electromagnet 111 here, the blocking element 20 is also displaced from its illustrated first position 21 to its second position by way of the functional connection established by the contact element 25. The storage element 10 is then no longer blocked in its tensioned position 11 by the blocking element 20. The auxiliary tripping device 1, in particular the storage element 10 of the auxiliary tripping device 1, is therefore once again ready to be activated by way of the activation element 14 in the event of a fluctuation in the subordinate power circuit and to emit its stored mechanical energy again by way of the trip element 13.

The above explanation of the embodiments simply describes the present invention in the context of examples. Individual features of the embodiments can of course be combined freely with one another, in so far as this is technically expedient, without departing from the scope of the present invention.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

1 Auxiliary tripping device
10 Storage element
11 Tensioned position of storage element
12 Movement of storage element
13 Trip element
14 Activation element
15 Cam on storage element
16 Movement of trip element
17 Spring element
20 Blocking element
21 First position of blocking element
22 Movement of blocking element
23 First contact surface
24 Second contact surface
25 Contact element
100 Electrical switching device
110 Handle
111 Electromagnet

What is claimed is:

1. An auxiliary tripping device for an electrical switching device, the electrical switching device being configured to interrupt a flow of current in an event of at least one of an undervoltage and a current pulse in a subordinate power circuit, the auxiliary tripping device comprising:

a spring element;

a storage element connected to the spring element, the storage element being movable between a tensioned position and a detensioned position;

a trip element for tripping a trip mechanism of the electrical switching device;

an activation element connected to the trip element, wherein the storage element is connected to the spring element such that the storage element stores a mechanical energy of the spring element when the storage element is in the tensioned position, wherein the storage element emits the stored mechanical energy to the trip element when the storage element is in the tensioned position and activated by the activation element; and a movably supported blocking element located adjacent to the storage element, the blocking element being functionally connected in a first position to the storage element when the storage element is in the tensioned position so that the storage element is held by the blocking element, the blocking element being configured to, in a second position, release the storage element to allow the storage element to perform a movement.

2. The auxiliary tripping device of claim 1, wherein the storage element is configured as a rotary wheel.

3. The auxiliary tripping device of claim 1, wherein the blocking element includes a first contact surface and a second contact surface, the first and second contact surfaces being configured to establish the functional connection between the storage element and the blocking element, the first contact surface allowing the storage element to be movable into the tensioned position during movement of the blocking element from the second position to the first position, and the second contact surface holding the storage element in the tensioned position when the blocking element is in the first position.

4. The auxiliary tripping device of claim 3, wherein the first and second contact surfaces are angled perpendicular or approximately perpendicular in relation to one another.

5. The auxiliary tripping device of claim 4, wherein the first and second contact surfaces are angled perpendicular or approximately perpendicular in relation to one another.

6. The auxiliary tripping device of claim 1, wherein the blocking element includes a contact element to establish a functional connection to the electrical switching device.

7. The auxiliary tripping device of claim 6, wherein the blocking element includes a contact element to establish a functional connection to a handle of the electrical switching device.

8. The auxiliary tripping device of claim 1, wherein the activation element is configured so that the activation element is functionally connectable to the electrical switching device, so that the activation element activates the storage element in the event of at least one of an undervoltage and a current pulse in a power circuit subordinate to the electrical switching device.

9. The auxiliary tripping device of claim 1, wherein the trip element is configured so that the trip element is functionally connectable to the electrical switching device so that, when the storage element is activated by the trip element, an interruption of the flow of current is brought about in the electrical switching device.

10. The auxiliary tripping device of claim 1, wherein the auxiliary tripping device is for a circuit breaker.

11. The auxiliary tripping device of claim 1, wherein the blocking element, while in the first position, is configured to hold the storage element in the tensioned position regardless of whether the activation element is activated.

12. An electrical switching device for interrupting a flow of current in the event of at least one of an undervoltage and a current pulse in a subordinate power circuit, the electrical switching device comprising:

at least two switching contacts, configured to permit a current to flow across, the at least two switching contacts being isolatable in the event of the least one of the undervoltage and the current pulse;

the auxiliary tripping device as claimed in claim 1; and a switching mechanism configured to isolate the switching contacts, wherein the switching mechanism is actuateable by the auxiliary tripping device in the event of at least one of the undervoltage and the current pulse in the subordinate power circuit.

13. The electrical switching device of claim 12, wherein the electrical switching device includes at least one electromagnet, through which at least some of the current can flow, the activation element of the auxiliary tripping device being functionally connected to the electromagnet in such a manner that the activation element activates the storage element in the event of at least one of the undervoltage and the current pulse in a power circuit subordinate to the electrical switching device.

14. The electrical switching device of claim 13, wherein the electrical switching device is a circuit breaker.

15. The electrical switching device of claim 14, wherein the electrical switching device is a molded case circuit breaker.

16. The electrical switching device of claim 13, wherein the electrical switching device includes a handle, the handle being functionally connected to the blocking element of the auxiliary tripping device in such a manner that the blocking element is optionally movable to the first or second position when the handle is actuated.

17. The electrical switching device of claim 12, wherein the electrical switching device includes a handle, the handle being functionally connected to the blocking element of the auxiliary tripping device in such a manner that the blocking element is optionally movable to the first position or second position when the handle is actuated.

* * * * *